United States Patent [19]

Oliver et al.

[11] 4,223,243

[45] Sep. 16, 1980

[54] TUBE WITH BONDED CATHODE AND ELECTRODE STRUCTURE AND GETTER

[75] Inventors: David W. Oliver; Norman T. Lavoo, both of Schenectady, N.Y.

[73] Assignee: The United States of America as represented by the Secretary of the Army, Washington, D.C.

[21] Appl. No.: 37,256

[22] Filed: May 9, 1979

[51] Int. Cl.[3] ..... H01J 1/88; H01J 19/42

[52] U.S. Cl. ..... 313/268; 313/174; 313/176; 313/250; 313/302; 313/348

[58] Field of Search ..... 313/348, 268, 107, 346, 313/174, 176, 250, 302

[56] References Cited

U.S. PATENT DOCUMENTS

| | | | |
|---|---|---|---|
| 3,154,711 | 10/1964 | Beggs | 313/348 X |
| 3,573,535 | 4/1971 | Hughes | 313/348 |
| 3,638,062 | 1/1972 | Beggs | 313/348 |
| 3,694,260 | 9/1972 | Beggs | 313/268 |
| 3,843,902 | 10/1974 | Miram et al. | 313/348 |
| 3,967,150 | 6/1976 | Lien et al. | 313/348 |

*Primary Examiner*—Saxfield Chatmon, Jr.

*Attorney, Agent, or Firm*—Nathan Edelberg; Jeremiah G. Murray; Bernard Franz

[57] ABSTRACT

The variety of technologies that have been applied in the development of a bonded grid cathode are described. These include chemical vapor deposition of tungsten, molybdenum, iridium BN, and $Si_3N_4$ on both sides of a sintered tungsten cathode disk. Zirconium and titanium getters have been used to eliminate nitrogen evolution problems. The getter plates are also used as heat shields for the bonded heater. Films of $Si_3N_4$ have been added to the insulation to prevent calcium and barium diffusion into the layer and maintain adequate resistivity and breakdown strength. Plasma etching was introduced as a method of removing $Si_3N_4$ from the cathode pores.

A new method, erosion lithography, is used for making the fine-detail grid structure, combining air erosion and lithographic techniques.

5 Claims, 10 Drawing Figures

FIG. 1 (Prior Art)
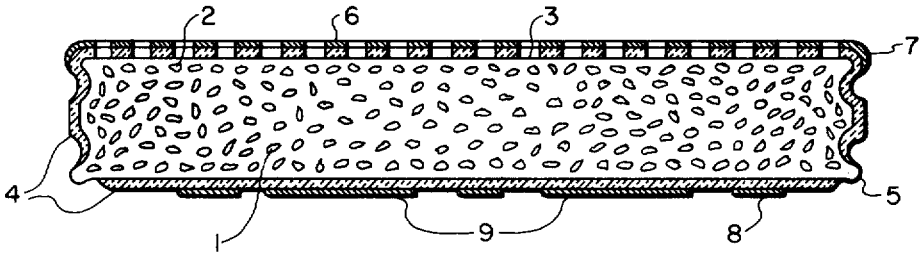
FIG. 2
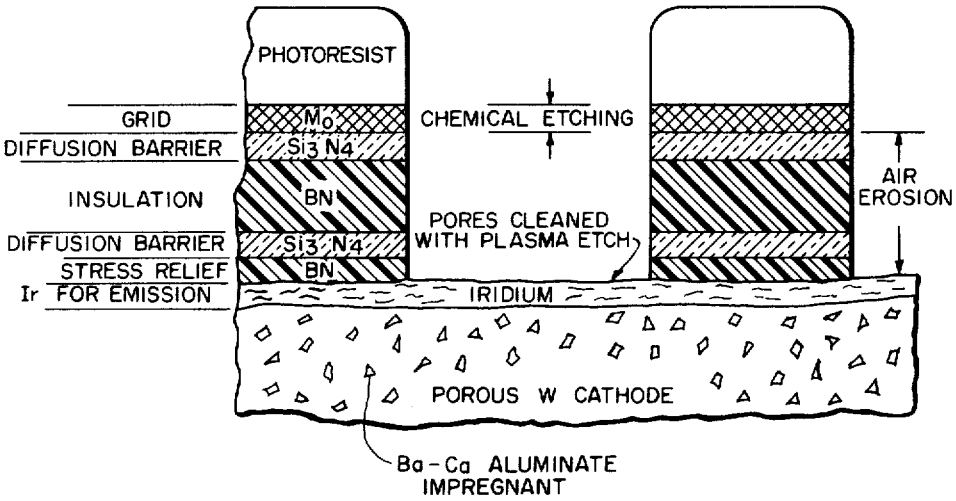
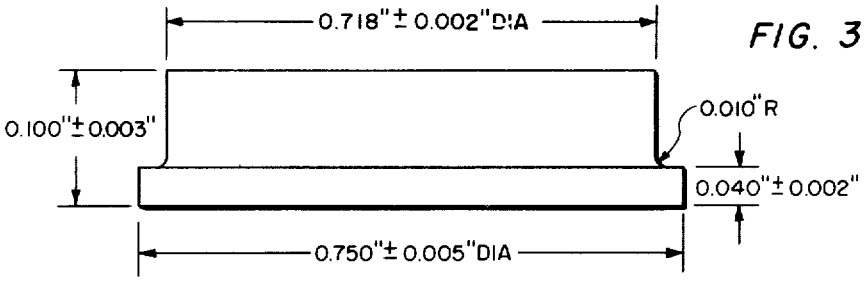
FIG. 3
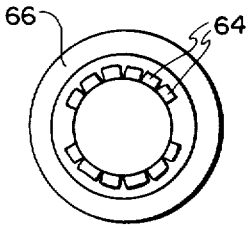
FIG. 5
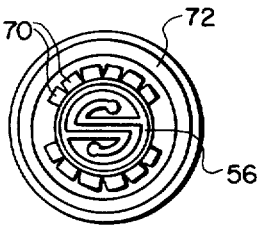
FIG. 6
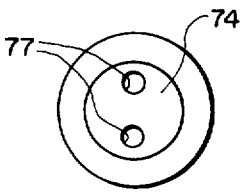
FIG. 7
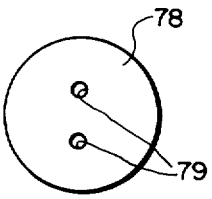
FIG. 8

TUBE WITH BONDED CATHODE AND ELECTRODE STRUCTURE AND GETTER

The invention described herein may be manufactured and used by or for the Government for governmental purposes without the payment of any royalties thereon or therefore.

BACKGROUND OF THE INVENTION

This invention relates to a microwave triode tube with a bonded cathode and electrode structure and a getter.

The grid-controlled power amplifier has long been useful for a variety of microwave applications. The L-64 and L-67 types, developed by J. E. Beggs and his associates as a consequence of work sponsored by the U.S. Army Electronics Command, have extended the range of performance of such devices. These advances were attained through the use of a closely spaced grid-cathode structure operating in the high-vacuum environment of a titanium-ceramic tube structure.

The construction of grid-cathode units with even closer spacing of grid and cathode and capable of high grid dissipation was continued using a grid and a heater which are rigidly bonded to the cathode by an insulating film. Boron nitride (BN) was identified as the preferred insulating material. Chemical vapor deposition (CVD) of BN was developed, and grid patterns with detail as small as 0.002 inch were formed by erosion through a mask with air driven $Al_2O_3$ particles. The d-c characteristics of bonded grid tubes showed a high utilization of emission as useful plate current, ability to withstand large positive grid bias, and the option of a high level of current collection or a wide grid-anode gap. See U.S. Pat. Nos. 3,599,031; 3,638,062; and 3,694,260 by J. E. Beggs.

Several significant technical problems remained, potentially blocking the successful development of still further improvements at higher microwave frequencies of a bonded grid triode. These were:

A continuous buildup of nitrogen gas within the tube when bonded grid-cathode structures were operated at 1050 degrees C. Tube characteristics were degraded in less than an hour of continuous operation.

Degradation of the grid-cathode and heater-cathode resistances by a factor of 1000 in about thirty hours of operation.

Lack of a process for forming grid openings with dimensions as small as 0.001 inch without either undercutting the supporting insulation or shorting out the insulating layer with metal.

SUMMARY OF THE INVENTION

An object of the invention is to reduce the buildup of nitrogen gas, and to provide an efficiently operating tube.

A feature of the invention relates to the combination getter and internal structure with heat shield.

Additional objects and features appear in the following detailed description.

CROSS REFERENCE TO RELATED APPLICATIONS

This application partially discloses matter claimed in related applications to be filed on the same day in the same package. The others are incorporated herein and made a part hereof as though fully set forth.

Features relating to the high resistivity electrical insulating layers of boron nitride with a diffusion barrier of silicon nitride are covered in an application by D. W. Oliver and C. R. Trzaskos, Ser. No. 037,257.

The method of erosion lithography and a high aspect ratio nozzle for obtaining uniform erosion to form the openings for fine grid detail are covered in an application by D. W. Oliver, Ser. No. 037,258.

DESCRIPTION OF THE DRAWING

FIG. 1 illustrates a prior art bonded grid-cathode-heater unit for a microwave vacuum tube;

FIG. 2 is a diagram of a section of a bonded grid-cathode structure, indicating steps of formation and the functions;

FIG. 3 shows a cathode blank as received from the manufacturer;

FIG. 5 is a view of the cathode subassembly from the grid side;

FIG. 6 is a view of the cathode subassembly from the heater side;

FIG. 7 is a view of the base from the getter-heat shield side;

FIG. 8 is a view of the base from the exterior side;

DETAILED DESCRIPTION

Figure 4:
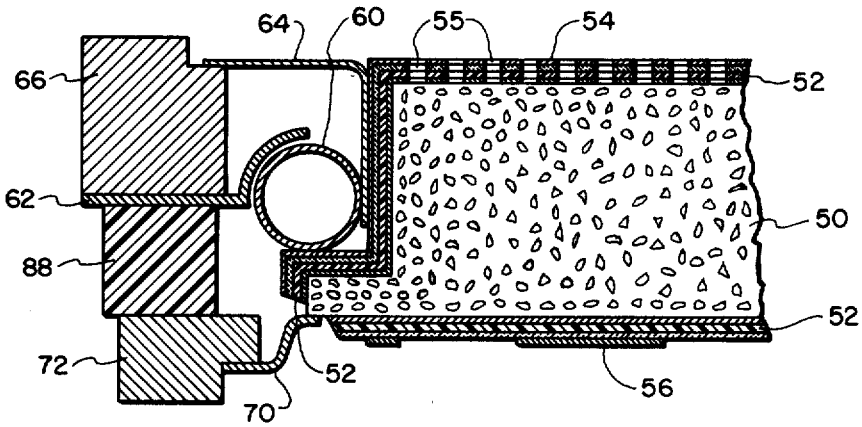
FIG. 4 is an enlarged cross section view of a part of the cathode subassembly.

FIG. 1 shows a cross section of a prior art bonded heater-cathode-grid structure for use in the microwave power-amplifier tube disclosed in U.S. Pat. No. 3,638,062 by J. E. Beggs. It embodies a cathode disk (twin-grooved around its edge, boron nitride (BN) insulation, and tungsten (W) film grid and heater electrodes. This control unit can be efficiently heated, can withstand large voltages between grid and cathode, and has a high grid dissipation capacity. It is operated in the tube near 1050 degrees C.

The cathode disk used in this assembly can be an impregnated type such as a Philips Type B or a Semicon Type S. The impregnant is removed from the outer surfaces prior to the BN deposition so as to prevent a direct reaction with the chemical vapors. This cleaning procedure also permits the BN insulation to become mechanically locked in the open pores of the tungsten surface.

Chemical vapor deposition processes are used to deposit BN and W layers onto the cathode. The completed structure is made by opening holes in the tungsten and BN layers. Other forms of the tube and of the bonded heater-cathode-grid structure are shown in U.S. Pat. No. 3,599,031 and 3,694,260 by J. E. Beggs. These patents show the structure and the method of manufacture, and include a discussion of alternate materials which may be used. The three Beggs patents are incorporated herein and made a part hereof by reference.

In FIG. 1, the tungsten cathode 1 has open pores 2, an emission impregnant and an emission surface 3. An insulating layer 4 of BN is formed on all sides by chemical vapor deposition. The portion of the insulating layer in and adjacent the lower groove is removed to provide a cathode contact region 5. A tungsten film is formed over the insulating layer, the perforations are formed by providing a mask and using a blast gun to erode through the insulating layer to form a control grid 6. The tungsten film extends to the upper groove to provide a grid contact region 7. A heater 8 is formed in the tungsten film on the opposite face, with heater contact regions 9. Grid patterns with detail as small as 0.002 inch have been formed by erosion through a mask with air driven by $Al_2O_3$ particles. U.S. Pat. No. 3,694,260 also discloses forming a photo resist layer over the tungsten film, developing a grid pattern therein, forming the grid holes in the tungsten film by etching, and using the photoresist and tungsten film as a composite mask for air blast erosion of the holes in the BN insulator.

Further development of the tube structure, and method of manufacturing it have continued, to obtain a tube whose characteristics are: a peak power output of one kilowatt at a duty factor of 0.1, a 1 db bandwidth of 400 megahertz at 3,300 megahertz, a power gain of 15 db, and an overall efficiency of 30%. Calculation shows that these characteristics require as tube parameters; grid-cathode capacitance equal or less than 175 picofarads, grid transparency of 75%, insulator dielectric constant of approximately 4; cathode area equal or less than 2.6 square centimeters, cathode emission density equal or greater than 1.4 ampere per square centimeter average or 6.4 ampere per square centimeter peak.

The most important parameters for selecting the insulating film are the film dielectric constant, resistivity, and stability at the cathode operating temperature. The preferred material selected is BN. This material also has a good expansion match to tungsten, and has the unique property among high resistivity refractories of being soft and, hence, not subject to cracking due to expansion differentials. Problems with BN were (1) a continuous buildup of nitrogen gas within the tube when bonded grid-cathode structures are operated at 1050 degrees C., and (2) degradation of the grid-cathode and heater-cathode resistances during operation.

NITROGEN GAS IN BONDED HEATER-CATHODE GRID TUBES

Some evaporation will occur with any material used in a tube with cold walls, and gas pressure can be expected to build up continuously (the equilibrium vapor pressure is not a limit) unless there is a getter present to remove the evolved gas. As evaporation proceeds, one can expect the surface or the bulk composition of the refractory to change. The electrical characteristics of the film are expected to change with the composition and an optimum gas pressure is likely to exist within the enclosure for highest electrical resistivity. It is possible in principle to approximate this optimum pressure by properly adjusting the gettering rate.

An ideal material for a high temperature insulator in a vacuum tube is one which evaporates congruently in molecular form without dissociation. However, most of the refractory high temperature insulators, oxides and nitrides, dissociate upon evaporation. For BN the dissociation products are B and $N_2$. Equilibrium between gas and solid occurs when the solid is heated in a closed container which has walls unreactive to the solid or its evaporation products. Under these conditions, the gas pressure increases until there is a balance between collisions of gas atoms on the surface and the evaporate flux of atoms away from the surface.

However, when a refractory is heated in an evacuated chamber with cold walls, as in a vacuum tube, the conditions are different from the thermal equilibrium situation. In fact, if a refractory which dissociates is allowed to evaporate in an enclosure with cold walls the internal pressure can be expected to increase well beyond the equilibrium vapor pressure. Consider BN. There will be a rate of evaporation of nitrogen which is greater than the rate of evaporation of boron. For every atom of boron which reaches the cold wall and is unable to recombine with nitrogen because of low reaction rate at the wall temperature there will be a nitrogen atom left in the enclosure and the gas pressure will rise continuously as the BN evaporates. Not only will the gas pressure rise but the BN will change its composition, since N is leaving faster than B. If the refractory is thick and nitrogen diffusion is slow, a boron-rich layer will build up on the surface until the evaporation rate for nitrogen is limited by diffusion to the values of the evaporation rate of boron. If the sample is thin and diffusion is rapid, then the average composition of the sample must alter, until the evaporation rates for boron and nitrogen balance.

Because the use of BN results in the liberation of nitrogen during operation, a getter is incorporated in the bonded grid tubes. Both zirconium and titanium will pump nitrogen, have a high solubility for nitrogen, do not release it when reheated, and are sufficiently refractory for tube assembly.

Titanium and zirconium getters have been assembled into tubes in the form of a pair of heat shields spaced close behind the cathode. Radiation from the cathode heats the getter plate to a temperature of about 840 degrees C. The heated getter plates not only pump nitrogen but also act as heat shields and reduce the heater power required to maintain cathode temperature. Tubes operated with titanium getters have shown no gassing problems. Zirconium getter plates are found to be superior to titanium, but commercial grade zirconium is not satisfactory because of impurities such as iron and the fact that it evolves hydrogen. Zirconium made by the iodide process and zone-refined zirconium have been found satisfactory as getter-heat shields in assembled tubes.

CHEMICAL VAPOR DEPOSITION

Low-Pressure Chemical Vapor Deposition of Boron Nitride

The CVD system has been converted to low-pressure operation.

Processing of the substrate prior to BN deposition included sandblasting with 400-grit alumina and then cleaning ultrasonically in ethyl alcohol. In a typical BN deposition, the system was then evacuated to a pressure of $1\times10^{-4}$ torr. The substrate was heated in vacuum at 1050 degrees C. and then in 10 percent $NH_3$: argon flow rate of 45 $cm^3$/min. With the substrate at 1100 degrees $C_b$, the $NH_3$ flow rate is adjusted to the desired value; typically 45 $cm^3$/min. The system pressure is adjusted to ½ the final operating pressure. $B_2H_6$: argon is introduced at 25 $cm^3$/min and BN deposition takes place at a relatively low rate. Deposition is continued under these conditions for 10 minutes with the substrate temperature maintained at 1100 degrees C. After 10 minutes the $B_2H_6$ flow rate is increased in steps of 5 $cm^3$/min at 2-minute intervals until the desired flow rate is reached; usually 45 $cm^3$/min. Final adjustment is made to the system pressure, typically set at 1 to 2 cm, and the deposition is continued for the length of time required to obtain the desired thickness of BN. The deposition rate at a system pressure of 2 cm is 0.8 mils/hr for the parameters just described.

A qualitative measure was made of the deposition rate dependence on the various deposition parameters. The total system pressure had a fairly strong influence on the rate of deposition, with a high system pressure (2 cm) giving a deposition rate several times lower than that attained at a few mm. The deposition rate was seen to increase at temperatures up to 1300 degrees C. Above this temperature the rate was seen to decrease, becoming zero in some instances at 1600 degrees C.

The influence of the nitrogen-to-boron ratio on the depositing rate was also examined. The deposition rate was higher than N:B of 3 as compared to N:B of 5 to 10. Most depositions have been made with a N:B ratio of 3.3. Depositions made with a N:B ratio less than 3 tended to give tan-colored films, perhaps due to free boron.

SUMMARY OF RESULTS AND CONCLUSIONS

A variety of technologies have been applied to the development of a bonded grid cathode as described. These include chemical vapor deposition of tungsten, molybdenum, iridium, BN, and $Si_3N_4$ in uniform deposits on both sides of a cathode. Zirconium and titanium getters were introduced to eliminate nitrogen evolution problems. Films of $Si_3N_4$ were added to the insulation to prevent calcium and barium diffusion into the layer and maintain adequate film resistivity and breakdown strength. Plasma etching was introduced as a method of removing $Si_3N_4$ from the cathode pores.

A new method, erosion lithography, was invented for making a fine-detail grid structure economically by combining air erosion, using rectangular nozzles, with lithographic methods. These developments provide the "tool kit" for building bonded grid tubes, as shown schematically in FIG. 2.

TUBE DESIGN

Figure 9:
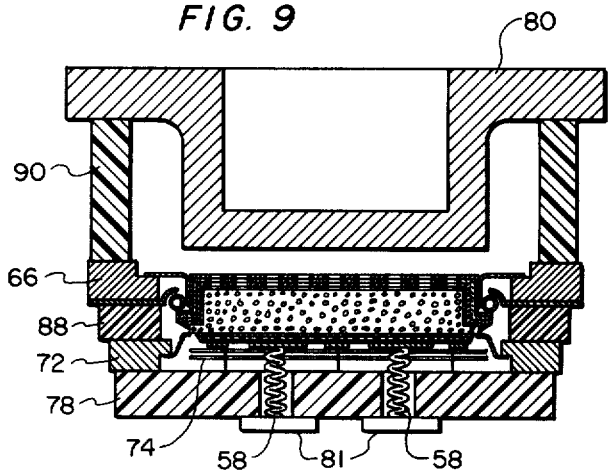
FIG. 9 is a cross section diagram of an assembled tube.
Figure 10:
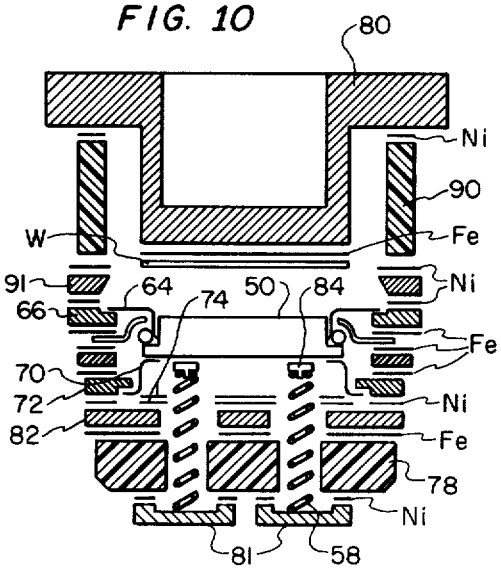
FIG. 10 is an exploded assembly drawing of another embodiment of a triode amplifier tube.

An assembled tube shown in FIG. 9, has views of subassemblies in FIGS. 4–8; and an exploded view of a later embodiment is shown in FIG. 10.

The cathode 50 and cathode mounting details are shown diagrammatically in FIG. 4. The cathode blank (FIG. 3) is a sintered tungsten cathode with barium-calcium aluminate impregnant. The insulation 52 is made up of as shown in FIG. 2 of a thin BN layer on the cathode, a thin silicon nitride layer, a principal thicker layer of BN and another $Si_3N_4$ layer. This insulation is formed on all of the surfaces of the cathode 50, but is removed around the lower outer edge to provide a contact area. A tungsten or molybdenum layer is deposited over the insulation. A photo resist is then formed over the metal layer and the grid and heater patterns formed by photo-lithography. At this point photo resist covers the grid 54 and heater 56. The metal in the grid openings 55 and around the heater is removed by chemical etching. Air abrasion is used to remove the insulation in the grid openings 55. The remaining photo resist is then removed.

The cathode is held in place by two Ta-W heater contact springs 58, FIG. 9, and by a toroidal cathode retaining spring 60 and the cathode retaining punching 62. A hafnium foil 64, 0.5 mils thick, is welded to the grid contact ring 65 and is held against the grid by the toroidal retaining spring 60 to provide electrical contact to the grid. A similar foil 70 is welded to the cathode and to the cathode contact ring 72. The foils are designed to approximate radial transmission lines and the grid foil 64 prevents the anode from "looking" directly at the edge of the cathode 50. The cathode sub-assembly is shown in FIG. 5 viewed from the grid side, and in FIG. 6 viewed from the heater side.

On a base under the cathode are two zirconium sheets 74 which serve as radiation heat shields and also as getters to pump the nitrogen which slowly evolves from the insulation when the cathode is operating at its rated temperature of 1050 degrees C. The grid foil 64 is shown in place in an input section in FIG. 5. Both foils 64 and 70 have been slotted so that they could be bent and so that evolved nitrogen might have a path to the getter-heat shields.

The base is shown in FIG. 7 viewed from the getter-heat shield side. The zirconium sheets have two holes 77 for the springs 58. FIG. 8 shows the base as viewed from the side of the exterior ceramic heater insulator 78, which also has two holes 79 for the springs 58.

FABRICATION PROCEDURE FOR THE BONDED-GRID TRIODE AMPLIFIER

The bonded-grid triode amplifier is fabricated in several parallel assembly steps.

The cathode blanks are manufactured by Semicon Associates, Inc., a subsidiary of Varian Associates. The first step in the cathode preparation is to polish the blanks because, as received from the manufacturer (see FIG. 3) the blanks have a lathe-cut surface. It is necessary to dry-polish in two stages; first with a coarse-grit polishing wheel and then with a fine polishing wheel, to remove machining marks and 2 to 3 mils of the original surface. The blanks are then sandblasted with alumina powder to provide a rough surface for better adhesion of the insulator layers. Residual traces of aluminum oxide are removed by cleaning the blanks ultrasonically in ethyl alcohol. The blanks are then hydrogen-fired at 1325 degrees C. (brightness temperature) for 10 minutes to remove contaminants which may have been introduced in the polishing operation. They are then activated in high vacuum at 1200 degrees C., to develop emission and to prepare them for the iridium coating.

The emission capabilities of the cathodes are measured prior to iridium coating. Iridium is then deposited on the cathodes by a chemical vapor deposition process. This process differs from evaporation or sputtering processes in that the chemical nature of the deposit differs from that of the vapor from which it was formed. In this instance iridium is obtained from the pyrolytic decomposition of iridium carbonyl. The purpose of the iridium film is to enhance the emission capability of the cathodes.

The next step in the process is to deposit the insulation on the surface of the iridium-coated cathodes. The insulation is a laminated structure (FIG. 2), with each discrete layer of the structure serving a specific function. This step of the process is again a chemical vapor deposition.

The first layer deposited is BN, 0.5 μm thick; this layer acts as a stress reliever between the substrate and the subsequently deposited layers. The next layer is $Si_3N_4$ 0.4 to 0.6 μm thick, which acts as a diffusion barrier, preventing cathode activators from diffusion into the insulating layer. Next, a layer of BN 10 to 15 μm thick is laid down to provide the required electrical insulation between the cathode and grid. The final layer is $Si_3N_4$ 0.2 to 0.3 μm thick; this serves to improve the adhesion between the metallic grid film and the insulating structure.

The grid film coating step follows the insulating coating. The metallic grid film is also obtained by a chemical vapor deposition process. In this case molybdenum carbonyl is decomposed on the cathode surface. The temperature of the cathode is held at 1075 degrees C. A partial pressure of hydrogen is used to prevent carbide formation. The thickness of the film is about 5 μm, obtained in a 45-minute coating cycle. The hydrogen pressure is about 20 microns; the $Mo(CO)_6+CO$ is also about 20 microns.

The grid and heater structures are photolithographed according to the following steps:

1. Application of photo-resist. The photo-resist material is spread over the surface of the cathode by means of a fresh, eye dropper type of dropping pipet. The cathode is then rotated at high speed (2000 to 8000 rpm). This spreads the photo-resist material into a thin, uniform layer.

2. A short baking cycle follows, during which the photo-resist layer is dried.

3. The process is then repeated on the opposite face of the cathode. This coat is also dried.

4. The grid and heater patterns are then formed by exposing the appropriate faces of the cathode through a mask to form the required patterns in the photo-resist.

5. Each unit is next put through a developing process which removes the unexposed photo-resist.

6. The final step in the photolithographic procedure is a bake which cures the photoresist and gives it the required toughness.

The grid and heater detail is then developed in the following steps:

1. The metal film is removed from the grid openings using an acid chemical etch. The etch time is 9 to 15 minutes. The heater side is etched at the same time to remove extraneous metal and leave the metal film heater pattern.

2. Nitride insulation is removed from the grid openings by an air abrasion method, using air-classified $Al_2O_3$ powder from which the fine and coarse fractions have been removed. A specially designed nozzle coupled to an automatic scanning device, with controlled air pressure, provides uniform abrasion over the entire exposed insulator surface of the cathode. The photoresist was previously developed to a toughness that will withstand the air abrasion until the insulation is substantially removed from the grid openings.

3. The cathode is subjected to ultrasonic cleaning is ethanol to remove $Al_2O_3$ particles which might be imbedded in the cathode surface.

4. The photo-resist is removed by heating the cathode to approximately 400 degrees C. in a low-pressure (10 microns) hydrogen atmosphere. At this temperature the photo-resist evaporates leaving no residue.

5. The cathode is again subjected to ultrasonic cleaning in ethanol to remove $Al_2O_3$ particles which had been imbedded in the photo-resist and still remain.

6. Any insulation remaining in the grid openings or lodged in the pores of the cathode is removed by etching with ionized freon gas.

7. The final step is firing the unit in hydrogen to remove surface contaminants and aid in reactivation of the cathode. This step ensures complete removal of fluorides. The structure is now ready for mounting within the vacuum enclosure.

Before describing the steps involved in mounting the cathode-grid structure in a vacuum enclosure, a parts list, the cleaning of punched parts, and the assembly of subsections will be given. FIG. 10 is a diagrammatic exploded view of the parts, and FIG. 9 is a cross section diagram of an earlier embodiment of an assembled tube. See also FIGS. 4–8.

Parts List

Anode Cup 80. Material is titanium; dimensions: plate diameter ¾ inch, well diameter ⅝ inch, well depth 7/16 inch, flange diameter 1½ inches, flange thickness 3/16 inch, bottom of flange to bottom of plate 7/16 inch.

Heater Contacts 81. Material is punched, 60-mil titanium; dimensions: ⅜-inch diameter with ¼ inch by 25 mils recess (2 each).

Cathode Contact Plate 82. Material is titanium; diameter 1-3/16 inches, disk thickness 60 mils; 2 clearance holes for heater contact springs, diameter 7/32 inch.

Cathode Contact Ring 72. Material is titanium; dimensions: 1-7/32-inch outside diameter by 1-13/16-inch inside diameter by 60 mils thick.

Cathode Contact Foil 70. (FIG. 4). Material is hafnium, hand cut with many 1/16-inch tabs, 0.4-mil thick.

Cathode Retaining Spring 60. Material is 5-mil tungsten; dimensions: 25 mils inside diameter by 2⅛ inches long.

Cathode Retainer Punching 62. Material is titanium; dimensions: 1-3/16-inch outside diameter by ¾-inch inside diameter by 1/64-inch thick; inner radius of curved portion to fit over cathode retaining spring as 1/32 inch.

Grid Contact Foil 64. Material is hafnium; hand cut with many 1/16-inch tabs, 0.4 mil thick.

Grid Contact Ring 66. Material is titanium; dimensions: 1-5/16 inches by ⅞ inch inside diameter by 60 mils thick.

The above listed parts plus some additional parts, listed below, are assembled to form:

Input Assembly. This consists of the cathode contact ring 72 listed above, 12.5-mil titanium flange (formed by die extrusion) 1-3/16-inch outside diameter by 47/64-inch inside diameter, a ceramic ring 88 1¼-inch outside diameter by ⅞-inch inside diameter by 1/16-inch thick, a bottom ring of titanium 1-5/16-inch outside diameter by ⅞-inch inside diameter by 60 mils thick.

Output Assembly. This consists of the anode cup 80 listed above, a ceramic cylinder 90 1¼-outside diameter by 1-1/6-inch inside diameter by 7/16-inch long, a bottom ring 91 of titanium 1-5/16-inch outside diameter by 1.0-inch inside diameter by 60 mils thick.

Cathode Blanks. Material is tungsten impregnated with barium calcium aluminate (see FIG. 3 for dimensions).

Springs and Heater Contact Buttons. Springs 58 are 20-mil wire of 92.5 percent tantalum+7.5 percent tungsten, wound ⅛-inch outside diameter; buttons 84 are tungsten 100 mils outside diameter by 84 mils inside diameter by 80 mils long.

Cleaning Punched Parts

All punched parts are mechanically cleaned by hand-rubbing with a wipe soaked in toluene. This is followed by cleaning in alcohol in an ultrasonic bath. Titanium parts are then fired at 1100 degrees C. in high vacuum, the temperature being increased slowly to 1100 degrees C. in order to allow hydrogen to evolve. To avoid unnecessary handling, the parts are tack-welded to tantalum wires and supported in a special frame during the firing.

Finished parts are stored in a desiccator. Zirconium getters 74 are placed between alumina plates held together with spring-loaded clamps so that they are under slight pressure as they are fired at 850 degrees C. (temperature measured by optical pyrometer focused on a carbon disk). The firing assembly is held at 850 degrees C. for 20 minutes, or until outgassed. Ceramic parts are fired in an air furnace at 1025 degrees C. Nickel and iron shims are simply wiped clean with toluene, and then further cleaned in an ultrasonic bath with alcohol.

Assembly of Subsections

The subsections that fit together to make the complete bonded grid triode are assembled separately and then joined systematically so as to avoid repetitious steps and prevent low-melting brazes from being performed before the high-melting ones.

Heater

The heater section is assembled first, as follows:

1. A 0.4-mil iron brazing foil is spot-welded to the cathode contact plate 82 with its two clearance holes. Clearance holes are cut out of the iron foil to match those in the cathode contact plate, and the foil is trimmed to the contour of the plate.

2. A ceramic disk 78 is placed on the foil so that its clearance holes line up with the clearance holes in the plate. It is essential to support all titanium parts with ceramic disks or slabs because titanium softens enough to become distorted during the brazing operation. All of these ceramic supports are vented to prevent air from being trapped or gas pockets from being formed.

3. An indicator called a "flag," of the same material as the brazing foil (in this case, electro-met iron), is tack-welded on the outside edge of the cathode contact plate 82. When this melts and is obviously alloying, the operation knows the braze is complete.

4. This subassembly is placed in a jig under spring pressure sufficient to assure a tight seal.

5. The temperature is then raised slowly (to maintain high vacuum while outgassing) to just below brazing temperature and held for 1 or 2 minutes. Then it is raised to 1085 degrees C., the iron brazing temperature. At this temperature the flag will alloy in and the temperature held for 20 seconds longer (it is important not to hold at alloying temperature too long, as depletion of alloy will occur). It is important when placing the jig in the vacuum chamber of the rf heater that the molybdenum susceptor surrounding the jig (radiates heat to subassembly) be placed so that the flag is visible through the opening in the susceptor.

6. The rf oscllator (heater) is then shut off and cooled for 1 hour or more.

Getter

The getter subsection is assembled next:

1. Two foils 74 of zirconium are cut into disks of 11/16-inch outside diameter.

2. Two clearance holes are cut to line up with the clearance holes in the cathode contact plate 82. These zirconium foils 74 are then fired as previously described.

3. 30-mil zirconium wire is cut in 1/16-inch lengths. Three lengths each are spot-welded 120 degrees apart, and one between the two clearance holes to keep the two getter foils spaced. Another four, 1/16-inch lengths are used to space the getter from the heater subsection.

Parts must not be handled with bare hands, and all shims (brazing or getter) must be held by spot-weld. All parts are centered as well as possible by eye.

4. After the heater subsection has cooled, the getter assembly is spot-welded to it, with the clearance holes carefully lined up.

Input

The input subsection follows:

1. An iron brazing shim is centered and tack-welded to the cathode contact ring.

2. The input ceramic ring is placed on the brazing shim.

3. An iron brazing shim is tack-welded to the cathode retainer punching and centered on the ceramic.

4. An iron brazing shim is spot-welded to the grid contact ring, and an iron flag spot-welded on the outside edge of the ring.

5. With the ceramic washer on top, the assembly is set in the jig under spring pressure.

6. It is placed in the vacuum chamber of the rf induction heater with the molybdenum susceptor positioned so that the flag is visible.

7. Following the directions and precautions mentioned above, it is fired in high vacuum at 1085 degrees C.

8. The rf oscillator is then shut off and cooled for 1 hour or more.

9. Before the cathode can be mounted, the outside of both rings of the assembly must have a step machined in them, after cooling from the above brazing (done with a special collet in the lathe).

10. Heater contact buttons are then machined.

Output

The next subsection to be assembled is the output section:

1. An 1-inch square foil of 1-mil tungsten is iron-brazed to the outside bottom surface of the anode cup, and trimmed to anode diameter. The tungsten is trimmed and ground to the outside diameter of the anode cup bottom.

2. A pure nickel flag is spot-welded on the edge of the anode cup flange.

3. A pure nickel brazing shim is spot-welded to the flange of the anode cup.

4. This anode cup assembly is centered on the ceramic cylinder.

5. A chamfer is machined on the inside diameter of the anode ring so that it tapers to about 30 mils to conform with the step in the grid contact ring.

6. The nickel brazing shum is spot-welded on the anode ring.

7. The other end of the ceramic cylinder is centered on so that the brazing shim is between the anode ring and the ceramic. This is the anode sealing ring.

8. The entire subsection is placed in a jig under spring pressure and fired in high vacuum at 955 degrees C., following the above stated directions and precautions.

Final Enclosure

The final enclosure steps are:

Mount Cathode Into Input Section

1. Spot-weld the hafnium foil 70 to the heater side of the cathode, after the area has been scraped clean.

2. Place hafnium foil 64 on the grid side of the cathode, using the toroidal retaining spring 60.

3. On the heater side bend and spot-weld all hafnium tabs to a step in the cathode ring.

4. Flip over; bend and spot-weld all hafnium tabs on the grid side to a step in the grid contact ring.

5. Place ceramic ring on the grid side of the cathode (facing down).

6. Spot-weld the nickel brazing shim to the heater side of the cathode contact ring 72. Spot-weld the nickel flag on the edge of the ring.

7. Place alignment plugs on the heater contact pads.

Join Input and Heater Sections

1. Lower the heater subsection over alignment plugs.

2. Withdraw the plugs and insert contact springs with contact buttons down.

3. Trim springs so that they extend only 1/16 inch above the ceramic plate.

4. Spot-weld a nickel brazing shim to the edge of the cup machined in the upper face of each contact.

5. Place on top of the springs with shims down.

6. Place a slab of ceramic on top to press down springs and hold is the jig.

7. Place the input and heater assemblies in the jig under spring pressure.

8. Place in the vacuum chamber of the induction heater with molybdenum susceptor positioned so that flags are visible.

9. Bond the heater section to the input section by brazing at 955 degrees C., being careful to allow the directions and precautions as before. At the same time, the heater contacts are brazed.

10. Shut off the rf oscillator after each brazing step and allow to cool for 1 hour or more.

11. Calibrate the heater.

Last Step: Seal On The Output Section

1. Spot-weld a nickel brazing shum to the anode ring of the output section.

2. Place the output section, tungsten surface up, on a ceramic slab to hold the jig in place.

3. Position three equally spaced 20-mil nickel wires 1/16-inch long on the grid contact ring and spot-weld them in place.

4. Place the contact ring so that the wires are resting on the nickel brazing shim of the output section. These wires assure adequate pump-out space.

5. Spot-weld a nickel flag on one of the flanges.

6. Place the entire assembly in a jig under spring pressure.

7. Place in the vacuum chamber of the induction heater with the molybdenum susceptor positioned so that flags are visible.

8. Heat to dull red—with pumping, under high vacuum—for 1 hour.

9. Raise the temperature to 955 degrees C. to braze all sections together, observing all precautions.

10. Shut off the rf oscillator and allow to cool for 1 hour or more. FIG. 9 is an exploded assembly drawing; the scale approximately double. Note: Hafnium foil is annealed during rolling. Springs of Ta-W are tempered by air firing for 10 or 15 minutes at 500 degrees C., they by hydrogen firing at 1000 degrees C. for 1 hour. Hafnium foil is spot-welded to a ring and slit to within 1/32 inch, using a copper form for ring size.

The finished tube is tested for cathode emission current at 1050 degrees C., using the calibrated heater. If it shows a reasonable emission current and $G_m$, it is rf-evaluated. The tube characteristics being sought are:

Peak power output of 1 kW at a duty factor of 0.1.
One-decibel bandwidth of 400 MHz at 3300 MHz
Power gain of 15 dB
Overall efficiency of 30 percent

What is claimed is:

1. Apparatus in an electron discharge device having a unitary heater, cathode, and control grid structure which comprises cathode formed from a circular disk of porous refractory metal having two spaced parallel outer surfaces and a peripheral edge, an inorganic insulating layer including boron nitride covering the surfaces of said disk except for a strip around part of the peripheral edge, and a film of refractory metal overlying substantially all of said insulating layer, the film on one surface having a gridlike configuration, the film on the other surface having a configuration of a heating element, said disk containing thermionic emissive material, and the insulating layer on said one surface having openings extending into the porous disk corresponding to the openings in the gridlike configuration of said film, whereby when the heating element is heated, electrons are directed through said openings in the insulating layer and the film on said one surface, the improvement comprising getter means mounted near the heating element to function both as a getter to pump evolved nitrogen gas and as a heat shield reducing the heater power required to maintain cathode temperature, wherein said getter means includes at least one thin disk spaced parallel to said other surface and substantially coextensive therewith;

said apparatus further including a grid contact foil extending around the entire periphery sealed to the edge of the film on the one surface having a gridlike configuration and also sealed to a grid contact ring; and a cathode contact foil sealed to said cathode at said strip around the peripheral edge and also sealed to a cathode contact ring; both said grid contact foil and said cathode contact foil being of thin metal with slots which permit passage of said nitrogen gas from the insulating layer on said one surface to said getter means.

2. Apparatus according to claim 1, wherein said getter means is zirconium made by the iodide process.

3. Apparatus according to claim 1, wherein said getter means is zone-refined zirconium.

4. Apparatus according to claim 1, wherein said getter means is titanium.

5. Apparatus according to claim 1, wherein said getter means includes two thin disks of purified zirconium parallel to each other spaced apart and mounted with zirconium wires.

* * * * *